US007635419B2

(12) United States Patent
Iijima et al.

(10) Patent No.: US 7,635,419 B2
(45) Date of Patent: Dec. 22, 2009

(54) SHOE PRESS APPARATUS OF A PAPER MACHINE AND PAPER PRODUCTION METHOD

(75) Inventors: Hidemasa Iijima, Mihara (JP); Takashi Bando, Mihara (JP); Hiroshi Iwata, Hiroshima (JP); Daisuke Goto, Hiroshima (JP); Takashi Nagaoka, Mihara (JP); Setsuo Suzuki, Mihara (JP); Kotaro Shinoda, Chuo-ku (JP)

(73) Assignee: OJI Paper Co., Ltd., Tokyo (JP)

( * ) Notice: Subject to any disclaimer, the term of this patent is extended or adjusted under 35 U.S.C. 154(b) by 368 days.

(21) Appl. No.: 11/582,498

(22) Filed: Oct. 18, 2006

(65) Prior Publication Data

US 2007/0084577 A1 Apr. 19, 2007

(30) Foreign Application Priority Data

Oct. 18, 2005 (JP) ..... 2005-302987

(51) Int. Cl.
*D21F 3/00* (2006.01)

(52) U.S. Cl. ..... 162/358.3; 162/358.1; 162/205; 162/198; 100/156

(58) Field of Classification Search ..... 162/358.3, 162/358.1, 205, 198; 100/156
See application file for complete search history.

(56) References Cited

U.S. PATENT DOCUMENTS

| | | | |
|---|---|---|---|
| 4,556,454 | A | 12/1985 | Dahl et al. |
| 4,576,682 | A | 3/1986 | Laapotti |
| 4,917,768 | A | 4/1990 | Ilmarinen |
| 5,167,768 | A | 12/1992 | Cronin et al. |
| 5,441,604 | A | 8/1995 | Sandberg et al. |
| 6,228,221 | B1 | 5/2001 | Loser et al. |

FOREIGN PATENT DOCUMENTS

DE 196 50 396 A1 6/1998

*Primary Examiner*—Mark Halpern
(74) *Attorney, Agent, or Firm*—Wenderoth, Lind & Ponack, L.L.P.

(57) ABSTRACT

A shoe press apparatus of a paper machine for pressing wet paper through a nip includes a counter roll, and a shoe module disposed adjacent to the counter roll. The shoe module includes a cylindrical blanket, and a press mechanism disposed inside the cylindrical blanket, extending in a width direction of the cylindrical blanket and individually pressing a plurality of pressed portions formed on the cylindrical blanket along a traveling direction of the wet paper, toward an outer-surface of the counter roll so that the wet paper is pressed in the nip between the cylindrical blanket and the counter roll so that a pressure can be applied efficiently in response to a density required for paper solely by the shoe press apparatus.

11 Claims, 8 Drawing Sheets

SHOE PRESS APPARATUS OF A PAPER MACHINE AND PAPER PRODUCTION METHOD

BACKGROUND OF THE INVENTION (1) Field of the Invention

This invention relates to a shoe press apparatus of a paper machine which is provided, for example, in a dewatering stage of the paper machine for pressing wet paper in a traveling state and a paper production method.

(2) Description of the Related Art

FIG. 7 is a view showing a shoe press apparatus of a conventional paper machine and is a sectional view taken along a plane of the shoe press apparatus perpendicular to the apparatus width direction (perpendicular direction to the plane of the figure). Such a shoe press as just mentioned is provided, for example, in a dewatering stage of the paper machine.

Referring to FIG. 7, the conventional shoe press apparatus shown includes a shoe module 120, and a counter roll 4 provided in an opposing relationship to the shoe module 120 and covered on the surface thereof with a rubber or a metal plate or formed using a metal cell having a high corrosion resisting property. Wet paper (which is sometimes referred to simply as paper) 1 sandwiched by a pair of felt webs 2 and 3 having a water absorbing property is pressed by a nip formed by the counter roll 4 and the shoe module 120 so that water included in the wet paper 1 is removed to the felt webs 2 and 3 to dewater the wet paper 1. It is to be noted that, in FIG. 7, an arrow mark $A_1$ indicates the direction of rotation of the counter roll 4, and another arrow mark $A_2$ indicates the direction of rotation of a blanket 6 hereinafter described while a further arrow mark $A_3$ indicates the traveling direction of the wet paper 1 and the felt webs 2 and 3.

The shoemodule 120 includes, as principal components thereof, a cylindrical blanket 6, a press mechanism 100 provided fixedly at a position opposing the counter roll 4 inside the blanket 6 for pressing the blanket 6 toward the counter roll 4, and a lubricating oil injection nozzle 21 provided fixedly on the upstream side in the direction of rotation of the blanket 6 with respect to the press mechanism 100 inside the blanket 6 for injecting lubricating oil toward the inner circumferential face of the blanket 6.

The blanket 6 is formed from a flexible member and is driven to rotate by the counter roll 4 when the counter roll 4 is driven to rotate. The press mechanism 100 includes, as principal components thereof, a piston block 101 extending in the apparatus width direction, a pair of grooved portions (recessed portions) 102 and 103 formed on an upper face 101*a* of the piston block 101, a pair of pistons 104 and 105 fitted in the grooved portions 102 and 103, respectively, a pair of pressurized oil supply paths 106 and 107 formed in the piston block 101 for supplying pressurized oil to bottom portions of the grooved portions 102 and 103 from the outside, and a shoe 109 disposed on the pistons 104 and 105 and extending in the apparatus width direction.

Further, while the piston 105 and the shoe 109 are in contact with each other, a piston bar 108 is interposed between the piston 104 and the shoe 109 such that, if the piston 104 moves in an upward or downward direction, then the shoe 109 smoothly moves in an upward or downward direction around a fulcrum provided by the contact point between the shoe 109 and the piston 105.

Furthermore, an upper face 109*a* (face opposing the counter roll 4) of the shoe 109 is formed in an arcuately concaved state such that it extends along the surface of the counter roll 4. The shoe 109 is pressed against the counter roll 4 with the blanket 6 interposed therebetween to form a nip between the counter roll 4 and the shoe module 120.

Further, in the shoe press apparatus shown in FIG. 7, the piston 105 is disposed at a position spaced by a distance $L_1$ to the upstream side in the paper traveling direction from a vertical line $R_0$ drawn vertically downwardly from the center 4*a* of rotation of the counter roll 4 (drawn in parallel to the direction of force exerted by the pistons 104 and 105). Meanwhile, the piston 104 is disposed at a position spaced by another distance $L_2$ (here, $L_2>L_1$) to the downstream side in the paper traveling direction from the vertical line $R_0$. Such a positional relationship of the pistons 104 and 105 as described above is set suitably.

Since the conventional shoe press apparatus is configured in such a manner as described above, if pressurized oil is supplied into a pressurized oil supply path 107, then the piston 105 is moved in an upward direction to push up the upstream side portion of the shoe 109 in the direction of rotation of the blanket 6. On the other hand, if pressurized oil is supplied to the pressurized oil supply path 106, then the piston 104 is moved in an upward direction to push up the downstream side portion of the shoe 109 in the direction of rotation of the blanket 6. In short, it is possible to adjust the force of the pistons 104 and 105 to push up the downstream side portion and the upstream side portion of the shoe 109 by varying the oil pressure of the pressurized oil to be supplied to the pressurized oil supply paths 106 and 107, respectively.

For example, in the shoe press apparatus ($L_2>L_1$) shown in FIG. 7, if the oil pressure $P_1$ of the pressurized oil to be supplied to the pressurized oil supply path 107 and the oil pressure $P_2$ of the pressurized oil to be supplied to the pressurized oil supply path 106 are set equal to each other (for example, to approximately 6.7 MPa), then such a pressure profile is obtained that the nip pressure applied to the wet paper 1 gradually increases from the upstream side end portion $E_1$ to the downstream side end portion $E_2$ of the shoe 109 in the paper traveling direction such that the highest nip pressure (peak nip pressure) $P_{100}$ (for example, approximately 6.8 MPa) is obtained at the location of the downstream side end portion $E_2$ of the shoe 109 in the paper traveling direction as seen in FIG. 8(*a*).

Meanwhile, if the oil pressure $P_2$ is set higher than the oil pressure $P_1$ (for example, $P_1$=approximately 5 MPa, $P_2$=approximately 8.3 MPa), then the gradient of the pressure profile shown in FIG. 8(*a*) becomes steeper, and for example, such a pressure profile as shown in FIG. 8(*b*) is obtained. In the pressure profile shown in FIG. 8(*b*), the peak nip pressure at the downstream side end portion $E_2$ of the shoe 109 in the paper traveling direction has a higher value (for example, approximately 8.5 MPa) $P_{200}$ than the peak nip pressure $P_{100}$.

On the other hand, if the oil pressure $P_2$ is set lower than the oil pressure $P_1$ (for example, $P_1$=approximately 8.3 MPa, $P_2$=approximately 5 MPa), then as shown in FIG. 8(*c*), the gradient of the pressure profile becomes less steep than the gradient of the pressure profile shown in FIG. 8(*a*). Further, the peak nip pressure $P_{300}$ at the downstream side end portion $E_2$ of the shoe 109 in the paper traveling direction has a value (for example, approximately 5 MPa) lower than the peak nip pressure $P_{100}$ shown in FIG. 8(*a*).

It is to be noted that, if the pressure profile is set such that the nip pressure at the downstream side end portion $E_2$ of the shoe 109 in the paper traveling direction is lower than the nip pressure at the upstream side end portion $E_1$ of the shoe 109 in the paper traveling direction, then water absorbed once from the wet paper 1 into the felt webs 2 and 3 returns to the wet paper 1. Therefore, the pressure profile is generally set such that the nip pressure at the downstream side end portion $E_2$ of the shoe 109 in the paper traveling direction is higher than the nip pressure at the upstream side end portion $E_1$ of the shoe 109 in the paper traveling direction as described hereinabove.

A shoe press apparatus of the type described is disclosed, for example, in U.S. Pat. No. 5,167,768 or U.S. Pat. No. 4,917,768.

Incidentally, a shoe press apparatus generally has a nip having a greater width than that of a nip formed, for example, by a pair of rolls and can apply a comparatively low pressure for a long period of time. Therefore, the shoe press apparatus can dewater the wet paper 1 without consolidating the same and is suitable to dewater bulky paper for which a thickness is required.

On the other hand, where a paper machine is used to produce paper having a comparatively small thickness and a high density such as coated base paper, it is necessary to crush (consolidate) the wet paper 1 with a higher peak nip pressure. It is to be noted that, where such coated base paper is to be produced, if the pressure to be applied to the wet paper 1 is insufficient, then this results in comparatively low interlayer strength of the inside of the wet paper 1, and there is the possibility that the inside of the wet paper 1 may be broken when it is dried (this phenomenon is called "blister").

Accordingly, it seems feasible, for example, to provide, in order to produce coated base paper, a pair of rolls on the downstream side in the paper traveling direction with respect to the shoe press apparatus to consolidate the wet paper 1. In this instance, however, the scale of the apparatus increases. Therefore, it is desired to make it possible for the shoe press apparatus by itself to be used for production not only of bulky paper but also of coated base paper.

However, with the conventional shoe press apparatus, even if the oil pressure $P_2$ is increased further to increase the peak nip pressure at the downstream side end portion $E_2$ of the shoe 109 in the paper traveling direction, although the peak pressure becomes higher than the peak nip pressure $P_{100}$ illustrated in FIG. 8(*a*) as in the case of the pressure profile shown in FIG. 8(*b*), the acting time of the peak nip pressure is very short, and it is difficult to effectively consolidate the wet paper 1. Further, although also it seems feasible to increase both the oil pressure $P_1$ and the oil pressure $P_2$ to generally increase the nip pressure, in this instance, this requires a very high linear pressure and hence is not efficient.

SUMMARY OF THE INVENTION

It is an object of the present invention to provide a shoe press apparatus of a paper machine and a paper production method wherein a shoe press apparatus by itself can be used to apply a pressure to paper efficiently in response to the required density of the paper.

In order to attain the object described above, according to an aspect of the present invention, there is provided a shoe press apparatus of a paper machine for pressing wet paper through a nip, comprising a counter roll, and a shoe module disposed adjacent to the counter roll and including a cylindrical blanket, and a press mechanism disposed inside the cylindrical blanket, extending in a width direction of the cylindrical blanket and individually pressing a plurality of pressed portions formed on the cylindrical blanket along a traveling direction of the wet paper, toward an outer-surface of the counter roll so that the wet paper is pressed in the nip between the cylindrical blanket and the counter roll.

With the shoe press apparatus of a paper machine, since the press mechanism has a plurality of pressed portions along the traveling direction of the wet paper that individually press the pressed portions of the blanket, by individually adjusting the pressing forces to the pressed portions, a necessary pressure can be applied efficiently not only to bulky paper (paper of a low density) but also to paper of a comparatively high density such as coated base paper, solely by the shoe press apparatus.

Preferably, the shoe press apparatus of a paper machine is disposed in a dewatering stage in the paper machine and further comprises a pair of felt webs, which respectively cover over and under the wet paper, traveling with the wet paper through the nip between the cylindrical blanket and the counter roll, the press mechanism pressing the wet paper between the pair of felt webs.

With the shoe press apparatus of a paper machine, water included in the wet paper can be transferred to the felt webs to dewater the wet paper.

Preferably, the shoe press apparatus of a paper machine further comprises a pair of the press mechanisms, which are individually disposed along the traveling direction of the wet paper, individually pressing the pressed portions, wherein one of the press mechanisms is disposed downstream of another of the press mechanisms.

With the shoe press apparatus of a paper machine, a necessary pressure can be applied efficiently by a simple configuration.

Preferably, a gap between the press mechanisms is set at less than or equal to 50 mm.

With the shoe press apparatus of a paper machine, the amount of water which returns from the felt webs to the wet paper in the gap section, that is, the rewetting water amount, can be reduced to a very low level.

Preferably, each of the pair of press mechanisms individually presses the wet paper through the cylindrical blanket toward a center of the counter roll.

With the shoe press apparatus of a paper machine, the wet paper can be pressed more efficiently.

Preferably, the show press apparatus of a paper machine further comprises an upstream pressed portion, which is one of the pressed portions, a downstream pressed portion which is another of the pressed portions, disposed downstream of the upstream pressed portion in the traveling direction of the wet paper, and a connecting portion which connects the press mechanisms corresponding to the upstream pressed portion and the downstream pressed portion respectively and is thinner than the press mechanisms.

With the shoe press apparatus of a paper machine, the connecting portion can be deformed readily, and the pressures to the two pressed portions can be changed individually without dividing the pressing mechanism completely into two portions. Further, the amount of water (rewetting water amount) which returns from the felt webs to the wet paper between the two pressed portions can be reduced to a very low level.

According to another aspect of the present invention, there is provided a paper production method using a shoe press apparatus including a counter roll and a shoe module disposed adjacent to the counter roll having a blanket and a press mechanism, which is disposed in the blanket for individually pressing wet paper through the blanket toward an outer-surface of the counter roll, extending in a width direction of the blanket so that wet paper is pressed in the nip between the blanket and the counter roll, the method comprising steps of forming at least two pressed portions on the blanket along a paper traveling direction with the press mechanism, and individually adjusting each of the pressures at the pressed portions.

With the paper production method, by individually adjusting the pressing forces to the pressed portions, a necessary pressure can be applied efficiently not only to bulky paper (paper of a low density) but also to paper of a comparatively high density such as coated base paper solely by the shoe press apparatus to produce paper.

The above and other objects, features and advantages of the present invention will become apparent from the following description and the appended claims, taken in conjunction with the accompanying drawings in which like parts or elements are denoted by like reference symbols.

DESCRIPTION OF THE PREFERRED EMBODIMENTS

In the following, preferred embodiments of the present invention are described with reference to the accompanying drawings.

A. First Embodiment

Figure 1:
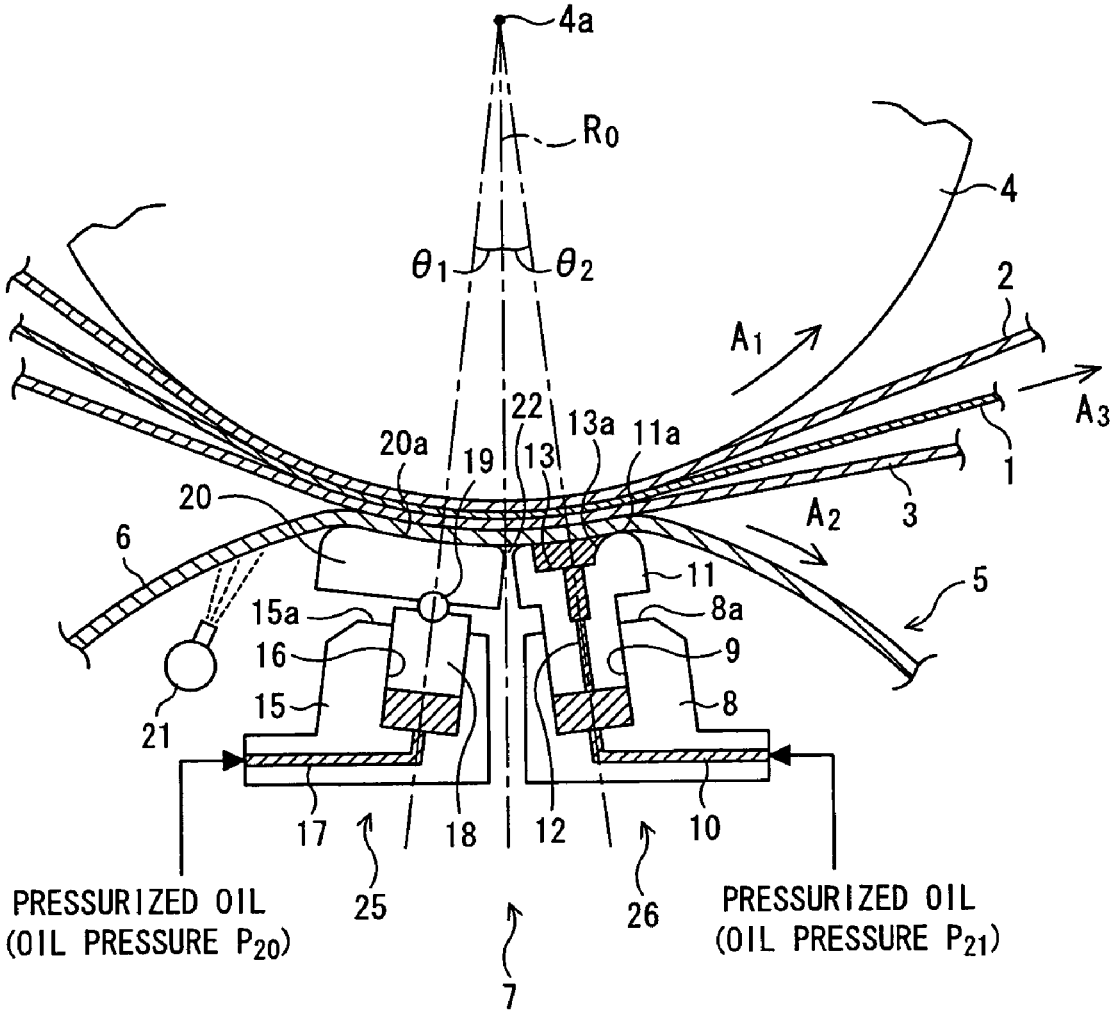
FIG. 1 shows a shoe press apparatus of a paper machine according to a first embodiment of the present invention and is a sectional view taken along a plane perpendicular to the width direction of the shoe press apparatus (direction perpendicular to the plane of the figure)
Figure 2A:
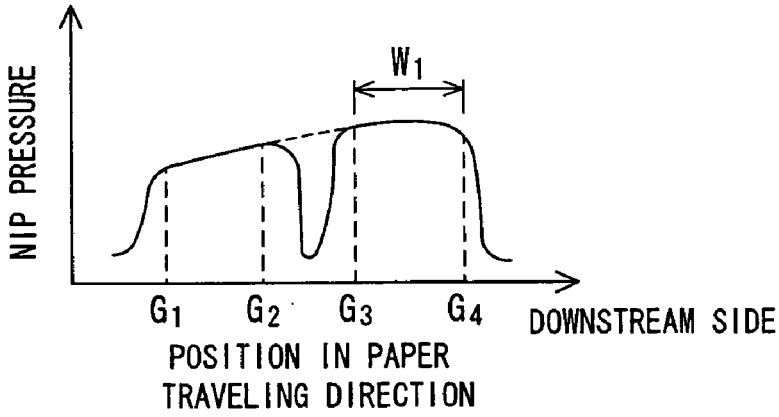
FIGS. 2(*a*) and 2(*b*) are diagrams illustrating operation of the shoe press apparatus of a paper machine of FIG. 1 and particularly illustrating different pressure profiles at a position of a shoe in a paper traveling direction.
Figure 2B:
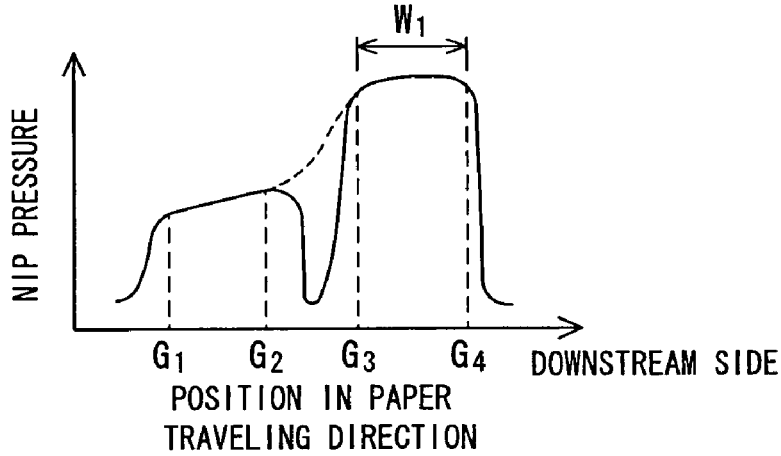
Figure 3:
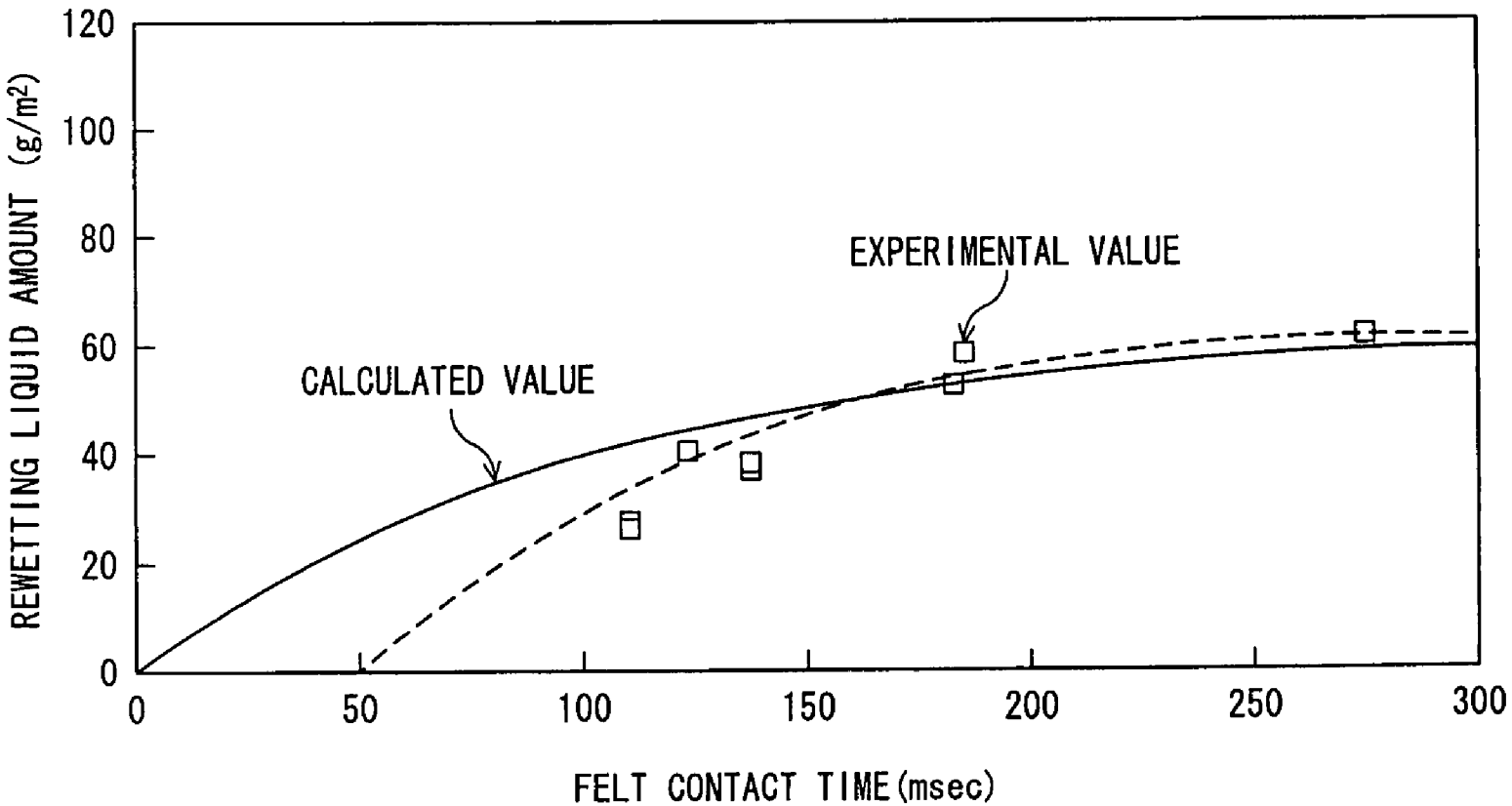
FIG. 3 is a graph illustrating a relationship between the felt contact time and the rewetting water amount upon dewatering by a common press.

FIGS. 1 to 3 show a shoe press apparatus of a paper machine according to a first embodiment of the present invention. In particular, FIG. 1 is a sectional view taken along a plane perpendicular to the width direction of the shoe press apparatus (direction perpendicular to the plane of the figure); FIGS. 2(*a*) and 2(*b*) are diagrams particularly illustrating different pressure profiles at a position of a shoe in a paper traveling direction; and FIG. 3 is a graph illustrating a relationship between the felt contact time and the rewetting water amount upon dewatering by a common press. It is to be noted that, in FIG. 1, like elements to those of the conventional shoe press apparatus described hereinabove are denoted by like reference characters. In the following description, it is assumed that the shoe press apparatus is provided in a dewatering stage of the paper machine.

Referring first to FIG. 1, the shoe press apparatus includes a shoe module 5, and a counter roll (metal roll) 4 provided in an opposing relationship to the shoe module 5 and coated at the surface thereof with a rubber or metal plate or formed from a metal cell having a high corrosion resisting property. Wet paper (which is sometimes referred to simply as paper) 1 sandwiched by a pair of felt webs 2 and 3 having a water absorbing property is pressed by a nip formed by the counter roll 4 and the shoe module 5 so that water included in the wet paper 1 is removed to the felt webs 2 and 3 to dewater the wet paper 1. It is to be noted that, in FIG. 1, an arrow mark $A_1$ indicates the direction of rotation of the counter roll 4, and another arrow mark $A_2$ indicates the direction of rotation of a blanket 6 while a further arrow mark $A_3$ indicates the traveling direction of the wet paper 1 and the felt webs 2 and 3. Further, although the shoe press apparatus shown is configured such that the counter roll 4 is provided above the shoe module 5 for the convenience of illustration and description, the counter roll 4 and the shoe module 5 may be disposed in a vertically reversed relationship or may be disposed horizontally.

The shoe module 5 includes, as principal components thereof, a cylindrical blanket 6, a press mechanism 7 provided fixedly at a position opposing to the counter roll 4 inside the blanket 6 for pressing the blanket 6 toward the counter roll 4, and a lubricating oil injection nozzle 21 provided fixedly on the upstream side in the direction of rotation of the blanket 6 with respect to the press mechanism 7 inside the blanket 6 for injecting lubricating oil toward the inner circumferential face of the blanket 6.

The blanket 6 is formed from a flexible member and is rotated by the counter roll 4 when the counter roll 4 is driven to rotate. Further, an oil film is formed from lubricating oil injected from the lubricating oil injection nozzle 21 on an inner circumferential face of the blanket 6 to prevent contact between the blanket 6 and a shoe 20 of the press mechanism 7.

In the present embodiment, the press mechanism 7 includes a first press mechanism 25 and a second press mechanism 26. The first press mechanism 25 applies an oil film to the blanket 6 making use of a hydrodynamic pressure. In particular, the first press mechanism 25 moves the blanket 6 relative to the shoe 20 to drag the lubricating oil between the blanket 6 and the shoe 20 into a gap between them to form an oil film which performs fluid lubrication. Meanwhile, the second press mechanism 26 applies an oil film to the blanket 6 making use of a hydrostatic pressure. In particular, the second press mechanism 26 feeds lubricating oil into the gap between the blanket 6 and the shoe 20 to form an oil film which performs fluid lubrication.

More particularly, the first press mechanism 25 is disposed on the upstream side in the paper traveling direction (or on the upstream side in the direction of rotation of the blanket 6) with respect to a vertical line $R_0$ drawn downwardly from the center 4*a* of rotation of the counter roll 4. Meanwhile, the second press mechanism 26 is disposed on the downstream side in the paper traveling direction (or on the downstream side in the direction of rotation of the blanket 6) with respect to the vertical line $R_0$.

The first press mechanism 25 includes a piston block 15 extending in the apparatus width direction. The piston block 15 has an upper face 15*a* formed in an inclined relationship such that it is opposed to the center 4*a* of rotation of the counter roll 4. In other words, the center 4*a* of rotation of the counter roll 4 is positioned vertically above the upper face 15*a* of the piston block 15.

A grooved portion (recessed portion) 16 is formed on the upper face 15*a* of the piston block 15 such that it extends fully along the apparatus width direction. The grooved portion 16 is formed vertically with respect to the upper face 15*a*. In other words, the grooved portion 16 is open toward the center 4*a* of rotation of the counter roll 4.

A piston 18 is fitted in the grooved portion 16, and a pressurized oil supply path 17 for supplying pressurized oil into a space between a lower face of the piston 18 and a bottom portion of the grooved portion 16 is formed inside the piston block 15. If pressurized oil is supplied from the outside into the pressurized oil supply path 17, then the piston 18 is moved in an upward direction, that is, in a direction toward the center 4*a* of rotation of the counter roll 4.

Further, the shoe (first shoe) 20 is disposed on the piston 18 with a piston bar 19 interposed therebetween and has an upper face 20*a* which contacts with the inner circumferential face of the blanket 6. The shoe 20 is formed as a plate extending in the apparatus width direction, and the upper face 20*a* of the shoe 20 is formed in an arc extending along the outer circumferential face of the counter roll 4. When the piston 18 is moved in an upward direction, the shoe 20 is pushed by the piston 18 through the piston bar 19 to press the blanket 6 toward its outer-surface, or more accurately toward the center 4*a* of rotation of the counter roll 4. Further, the angle defined by the vertical line $R_0$ and the pressing direction by the shoe 20 here is set to $\theta_1$.

Further, the upper face 20*a* of the shoe 20 is formed in a rather rounded shape at end portions thereof on the upstream side and the downstream side in the direction of rotation of the blanket 6 so as to prevent damage to the blanket 6.

Meanwhile, the second press mechanism 26 includes a piston block 8 extending in the apparatus width direction. The piston block 8 has an upper face 8*a* formed in an inclined relationship such that it is opposed to the center 4*a* of rotation of the counter roll 4. In other words, the center 4*a* of rotation of the counter roll 4 is positioned vertically upwardly of the upper face 8*a* of the piston block 8.

A grooved portion (recessed portion) 9 is formed on the upper face 8*a* of the piston block 8 such that it extends fully in the apparatus width direction. The grooved portion 9 is formed perpendicularly to the upper face 8*a*. In other words, the grooved portion 9 is open toward the center 4*a* of rotation of the counter roll 4.

A piston shoe (secondshoe) 11 is fitted in the grooved portion 9, and a pressurized oil supply path 10 for supplying pressurized oil into a gap between a lower face of the piston shoe 11 and a bottom portion of the grooved portion 9 is formed inside the piston block 8. Then, as pressurized oil is supplied from the outside into the pressurized oil supply path 10, the piston shoe 11 is moved in an upward direction, that is, in a direction toward the center 4*a* of rotation of the counter roll 4. Further, the angle defined between the vertical line $R_0$ and the pressing direction by the piston shoe 11 here is set to $\theta_2$.

An upper face 11*a* of the piston shoe 11 contacts with the inner circumferential face of the blanket 6. Further, one or a plurality of shoe grooved portions 13 are formed fully over the apparatus width direction at an intermediate portion of the upper face 11*a* of the piston shoe 11 in the direction of rotation of the blanket 6. Furthermore, a connecting path 12 is formed inside the piston shoe 11 such that it interconnects a bottom portion of the shoe grooved portion 13 and a lower face of the piston shoe 11 such that pressurized oil supplied into a space between the lower face of the piston shoe 11 and the bottom portion of the grooved portion 9 of the piston block 8 through the pressurized oil supply path 10 is supplied into the shoe grooved portion 13 through the connecting path 12 of the piston shoe 11 to press the blanket 6 toward the outer-surface of the counter roll 4 while the lubricating oil is supplied into the gap between the piston shoe 11 and the blanket 6.

Further, the upper face 11*a* of the piston shoe 11 is formed in a rather rounded manner at end portions thereof on the upstream side and the downstream side in the direction of rotation of the blanket 6 so that damage to the blanket 6 may be prevented. Furthermore, also an upper portion of a wall portion 13*a* of the shoe grooved portion 13 on the downstream side in the direction of rotation of the blanket 6 is rounded so that damage to the blanket 6 may be prevented.

Further, a gap 22 between the end portion of the shoe 20 on the downstream side in the direction of rotation of the blanket 6 and the end portion of the piston shoe 11 on the upstream side in the direction of rotation of the blanket 6 is preferably set to 50 mm or less. More preferably, the gap 22 is set to 25 mm or less.

The shoe press apparatus according to the first embodiment of the present invention is configured in such a manner as described above. Therefore, the pressure profile of the shoe press apparatus in the paper traveling direction (direction of rotation of the blanket 6 or direction of rotation of the counter roll 4) becomes such a pressure profile as illustrated in FIG. 2(*a*) or 2(*b*). It is to be noted that, in FIGS. 2(*a*) and 2(*b*), reference character $G_1$ denotes the position of the end portion of the shoe 20 on the upstream side in the paper traveling direction, $G_2$ the position of the end portion of the shoe 20 on the downstream side in the paper traveling direction, $G_3$ the position of the end portion of the piston shoe 11 on the upstream side in the paper traveling direction, and $G_4$ the position of the end portion of the piston shoe 11 on the downstream side in the paper traveling direction.

For example, in order to produce bulky paper (for example, paper density: 0.6 g/cc), a comparatively low peak nip pressure is required, and therefore, the oil pressure $P_{20}$ of the first press mechanism 25 and the oil pressure $P_{21}$ of the second press mechanism 26 are set so that both of the nip pressure of the shoe 20 and the nip pressure of the piston shoe 11 are low and besides are substantially equal to each other as seen in FIG. 2(*a*). On the other hand, in order to produce paper having a small thickness (for example, paper density: 0.76 g/cc) such as coated base paper, a comparatively high peak nip pressure is required. However, if it is tried to assure a high peak nip pressure over the entire nip portion, then a very high oil pressure is required and cannot be obtained efficiently. Therefore, the oil pressure $P_{20}$ of the first press mechanism 25 and the oil pressure $P_{21}$ of the second press mechanism 26 are set such that only the nip pressure in a required region, that is, the nip pressure (nip pressure of the piston shoe 11) on the downstream side in the paper traveling direction as seen in FIG. 2(*b*), is high.

In this manner, according to the present shoe press apparatus, the pressed portion at the nip portion is divided into two pressed portions on the upstream side and the downstream side in the paper traveling direction such that the pressing forces in the two pressed portions can be changed individually or independently of each other. Consequently, a necessary pressure can be applied efficiently in response to the density required for the paper. For example, as described hereinabove, a necessary pressure can be applied efficiently to bulky paper and also to paper for which a comparatively high density is required, to consolidate the paper. Further, since this can be achieved solely by the shoe press apparatus, there is no necessity to provide a pair of rolls for pressing coated base paper as in the prior art shoe press apparatus described hereinabove, and also increase in scale of the apparatus can be prevented. Furthermore, the advantages described above can be implemented by such a simple construction that the pressed portion is divided into two pressed portions as in the present embodiment.

It is to be noted that, as shown in FIG. 3, it is known that, where the wet paper 1 is pressed in a state wherein it is sandwiched by the two felt webs 2 and 3, generally the amount of water (rewetting water amount) which returns to the wet paper 1 after removal from the wet paper 1 to the felt webs 2 and 3 increases, with regard to both of the calculated value (solid line) and the experimental value (broken line), as the felt contact time increases, and the rewetting water amount approaches to approximately 60 g/m$^2$ per one felt web. In particular, after the wet paper 1 leaves the nip, it absorbs an amount of water which is the rewetting water amount described above. Accordingly, where the gap 22 is formed between the shoe 20 and the piston shoe 11 as in the present embodiment, water may possibly return from the felt webs 2 and 3 to the wet paper 1 within a period of time after the wet paper 1 passes the nip of the shoe 20 and the counter roll 4 until it advances to the nip of the piston shoe 11 and the counter roll 4. However, since the time in which the gap 22 passes is very short, this has little influence on the entire rewetting water amount. While the paper machine according to the present embodiment can operate at a high speed of approximately 1,500 rpm or more, where it operates, for example, at a low speed of approximately 500 rpm, the time in which the wet paper 1 passes the gap 22 is as short as several milliseconds. Further, for example, where the gap 22 is 25 mm, the rewetting water amount is as small as 4 g/m$^2$, and where the gap 22 is approximately 50 mm, the rewetting water amount is as small as approximately 6 g/m$^2$. Therefore, the gap 22 is not a factor in increasing the entire rewetting water amount. From this reason, the gap 22 is preferably set less than or equal to 50 mm, and more preferably is set less than or equal to 25 mm as described hereinabove.

Further, while, in the present embodiment, a static pressure is applied by the piston shoe 11, since an oil film is likely to be formed between the inner circumferential face of the blanket 6 and the piston shoe 11 with such a static pressure, damage to the inner circumferential face of the blanket 6 can be prevented. Also there is another advantage in that a more stabilized pressure can be applied readily.

Furthermore, the pressing width $W_1$ (refer to FIG. 2) formed by the piston shoe 11 in the paper traveling direction preferably is approximately 75 to 100 mm. If such a pressing width $W_1$ is used, then where, for example, coated base paper is to be pressed, it is possible to apply a sufficient pressure to consolidate the wet paper 1.

B. Second Embodiment

Figure 4A:
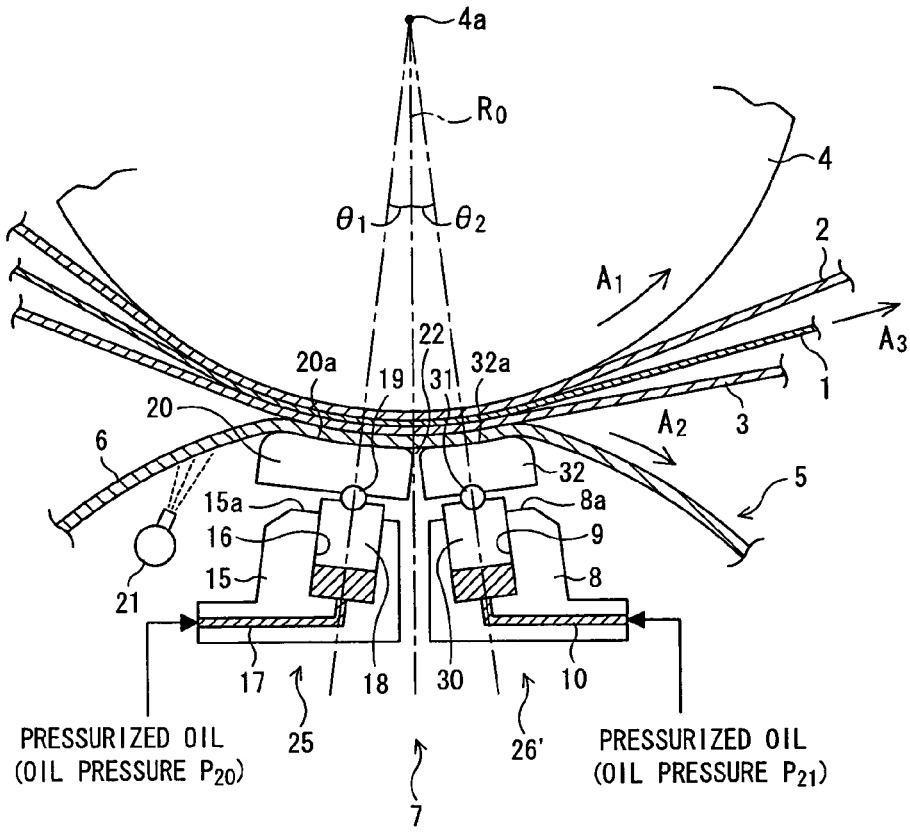
FIG. 4(*a*) shows a shoe press apparatus of a paper machine according to a second embodiment of the present invention and is a sectional view taken along a plane perpendicular to the width direction of the shoe press apparatus (direction perpendicular to the plane of the figure), and FIG. 4(*b*) is a sectional view showing a modified form of a shoe 32 of the shoe press apparatus shown in FIG. 4(*a*)
Figure 4B:
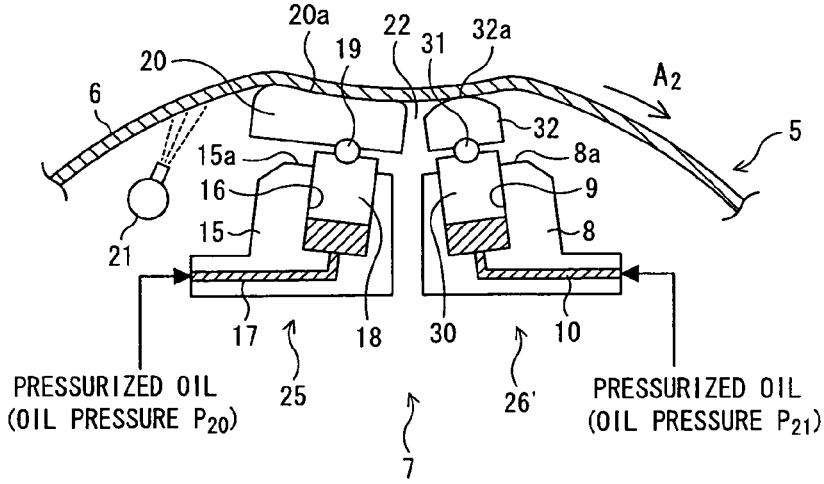

FIGS. 4(*a*) and 4(*b*) show a shoe press apparatus of a paper machine according to a second embodiment of the present invention and are sectional views taken along a plane perpendicular to the width direction of the shoe press apparatus (direction perpendicular to the plane of the figure). Here, FIG. 4(*b*) shows a modification wherein a shoe 32 of the shoe press apparatus shown in FIG. 4(*a*) is modified in shape. It is to be noted that, in FIGS. 4(*a*) and 4(*b*), like elements to those of the prior art apparatus and the first embodiment described hereinabove are denoted by like reference characters. Further, FIG. 4(*b*) shows only the shoe module 5.

Referring to FIG. 4(*a*), the shoe press apparatus according to the present embodiment is different from that of the first embodiment in a second press mechanism 26' of the press mechanism 7 of the shoe module 5. In the following, the second press mechanism 26' is described while the configuration of the other part of the shoe press apparatus of the present embodiment is omitted herein because it is similar to that of the first embodiment.

The second press mechanism 26' in the present embodiment is a hydrodynamic pressure type press mechanism similar to that of the first press mechanism 25. In particular, the second press mechanism 26' includes a piston block 8 extending in the apparatus width direction. The piston block 8 has an upper face 8*a* formed in an inclined relationship such that it is opposed to the center 4*a* of rotation of the counter roll 4. In other words, the center 4*a* of rotation of the counter roll 4 is positioned vertically upwardly of the upper face 8*a* of the piston block 8.

A grooved portion (recessed portion) 9 is provided on the upper face 8*a* of the piston block 8 such that it extends fully in the apparatus width direction. The grooved portion 9 is formed perpendicularly to the upper face 8*a*. In other words, the grooved portion 9 is open toward the center 4*a* of rotation of the counter roll 4.

A piston 30 is fitted in the grooved portion 9, and a pressurized oil supply path 10 for supplying pressurized oil into a gap between a lower face of the piston 30 and a bottom portion of the grooved portion 9 is formed inside the piston block 8. Then, as pressurized oil is supplied from the outside into the pressurized oil supply path 10, the piston 30 is moved in an upward direction, that is, in a direction toward the center 4*a* of rotation of the counter roll 4.

A shoe 32 is disposed on the piston 30 with a piston bar 31 interposed therebetween such that an upper face 32a of the shoe 32 contacts with the inner circumferential face of the blanket 6. In the embodiment shown in FIG. 4(*a*), the shoe 32 is formed as a plate extending in the apparatus width direction, and the upper face 32*a* of the shoe 32 is formed in an arc which extends along the outer circumferential face of the counter roll 4. Thus, if the piston 30 is moved in an upward direction, then the shoe 32 is pushed by the piston 30 through the piston bar 31 to press the blanket 6 toward its outer-surface, or more accurately toward the center 4*a* of rotation of the counter roll 4. Here, the angle defined by the vertical line $R_0$ and the pressing direction by the shoe 32 is set to $\theta_2$.

The upper face 32*a* of the shoe 32 is formed in a rounded manner at end portions thereof on the upstream side and the downstream side in the direction of rotation of the blanket 6 so that damage to the blanket 6 may be prevented.

Since the shoe press apparatus of a paper machine according to the second embodiment of the present invention is configured in such a manner described above, different pressures can be applied to the upstream side and the downstream side in the paper traveling direction by the shoe 20 of the first press mechanism 25 and the shoe 32 of the second press mechanism 26'. Consequently, advantages similar to those achieved by the first embodiment can be achieved.

It is to be noted that the shape of the shoe 32 is not limited to that shown in FIG. 4(*a*), but it may be formed, as another modification, so as to have a convex shape as seen in FIG. 4(*b*) to further raise the consolidating performance for wet paper.

C. Third Embodiment

Figure 5:
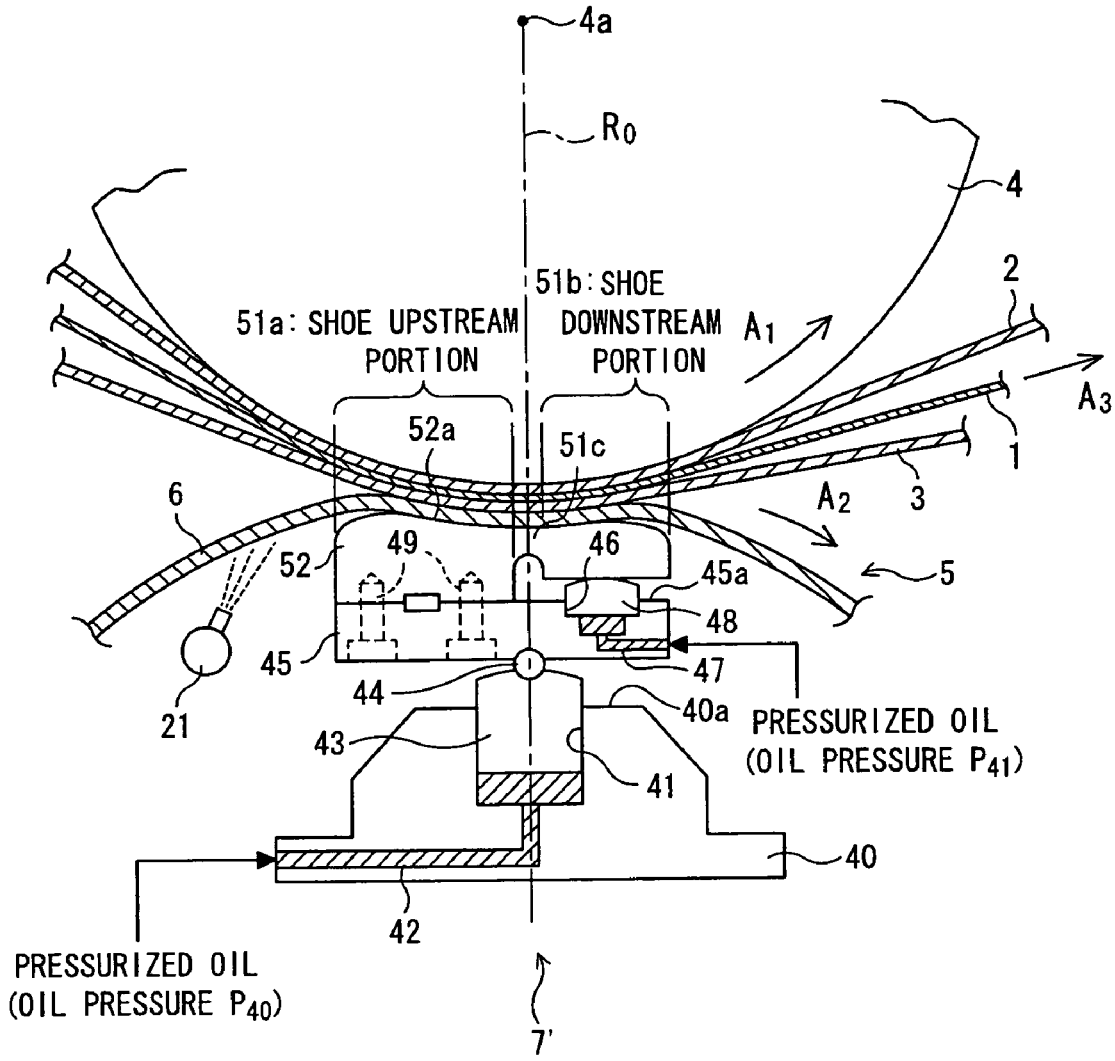
FIG. 5 shows a shoe press apparatus of a paper machine according to a third embodiment of the present invention and is a sectional view taken along a plane perpendicular to the width direction of the shoe press apparatus (direction perpendicular to the plane of the figure)

FIG. 5 shows a shoe press apparatus of a paper machine according to a third embodiment of the present invention and particularly is a sectional view taken along a plane perpendicular to the width direction of the shoe press apparatus (direction perpendicular to the plane of the figure). It is to be noted that, in FIG. 5, like elements to those of the prior art apparatus and the first embodiment described hereinabove are denoted by like reference characters.

Referring to FIG. 5, the shoe press apparatus according to the present embodiment is different from that of the first embodiment in a press mechanism 7' of the shoe module 5. In the following, the press mechanism 7' is described while the configuration of the other part of the shoe press apparatus of the present embodiment is omitted herein because it is similar to that of the first embodiment.

The press mechanism 7' in the present embodiment includes a piston block 40 extending in the apparatus width direction. Here, the piston block 40 is disposed on a vertical line $R_0$ drawn in a vertically downward direction from the center 4*a* of rotation of the counter roll 4. The piston block 40 has an upper face 40*a* formed horizontally so as to be opposed to the center 4*a* of rotation of the counter roll 4. In other words, the center 4*a* of rotation of the counter roll 4 and a piston bar 44 are positioned on a straight line in a vertically upward direction above the upper face 40*a* of the piston block 40. It is to be noted, however, that the positions of the piston block 40 and the piston bar 44 are not limited to the specific position vertically downwardly of the counter roll 4 similarly as in the first embodiment.

The upper face 40*a* of the piston block 40 has a grooved portion (recessed portion) 41 formed thereon fully along the apparatus width direction. The grooved portion 41 is formed perpendicularly to the upper face 40*a*. In other words, the grooved portion 41 is open toward the center 4*a* of rotation of the counter roll 4.

A piston 43 is fitted in the grooved portion 41, and a pressurized oil supply path 42 for supplying pressurized oil into a gap between a lower face of the piston 43 and a bottom portion of the grooved portion 41 is formed inside the piston block 40. As pressurized oil is supplied from the outside into the pressurized oil supply path 42, the piston 43 is moved in an upward direction, that is, in a direction toward the center 4*a* of rotation of the counter roll 4.

A base member 45 is disposed on the piston 43 with the piston bar 44 interposed therebetween, and a shoe 52 is attached to an upper portion of the base member 45 by means of bolts 49. The shoe 52 has an upper face 52a which contacts with the inner circumferential face of the blanket 6. The shoe 52 is formed as a plate extending in the apparatus width direction, and the upper face 52*a* is formed in an arc which extends along the outer circumferential face of the counter roll 4. If the piston 43 is moved in an upward direction, then the shoe 52 is pushed by the piston 43 through the piston bar 44 to press the blanket 6 toward its outer-surface, or more accurately toward the center 4*a* of rotation of the counter roll 4.

Further, the upper face 52*a* of the shoe 52 is formed in a rounded manner at end portions thereof on the upstream side and the downstream side in the direction of rotation of the blanket 6 so that damage to the blanket 6 may be prevented.

A portion (shoe upstream portion) 51*a* of the shoe 52 on the upstream side in the direction of rotation of the blanket 6 with respect to the vertical line $R_0$ is secured to the upper face of the base member 45 by the bolts 49. Meanwhile, the other portion (shoe downstream portion) 51*b* of the shoe 52 on the downstream side in the direction of rotation of the blanket 6 with respect to the vertical line $R_0$ is formed with a reduced thickness when compared with the shoe upstream portion 51*a*. Further, a portion between the shoe upstream portion 51*a* and the shoe downstream portion 51*b*, that is, a portion (connection portion) 51*c* at which the shoe 52 and the vertical line $R_0$ intersect with each other, is formed further thinner than that of the shoe downstream portion 51*b* so that it can be deformed more readily than the shoe upstream portion 51*a* and the shoe downstream portion 51*b*.

A gap is formed between a lower face of the shoe downstream portion 51*b* and an upper face 45*a* of the base member 45. Further, at a position of the upper face 45*a* of the base member 45 which corresponds to the shoe downstream portion 51*b*, that is, at a position of the upper face 45*a* of the base member 45 on the downstream side in the direction of rotation of the blanket 6, a grooved portion (recessed portion) 46 is formed in a belt-like shape fully along the apparatus width direction. A piston 48 is fitted in the grooved portion 46. Further, a pressurized oil supply path 47 for supplying pressurized oil into a gap between a lower face of the piston 48 and a bottom portion of the grooved portion 46 is formed inside the base member 45. As pressurized oil is supplied from the outside into the pressurized oil supply path 47, the piston 48 is moved in an upward direction. Consequently, the upper face of the piston 48 contacts with a lower face of the shoe downstream portion 51*b* to push up the shoe downstream portion 51*b* in an upward direction around a fulcrum provided by the connection portion 51*c*.

Since the shoe press apparatus of a paper machine according to the third embodiment of the present invention is configured in such a manner as described above, the pressing force of the entire shoe 52 can be adjusted by adjusting the oil pressure $P_{40}$ of the pressurized oil to be supplied into the pressurized oil supply path 42. Further, the pressing force of the shoe downstream portion 51*b* can be adjusted by adjusting the oil pressure $P_{41}$ of the pressurized oil to be supplied into the pressurized oil supply path 47.

In this manner, also in the present embodiment, the pressed portion at the nip portion can be divided into two pressed portions (here, two hydrodynamic pressure portions of the shoe upstream portion 51*a* and the shoe downstream portion 51*b*) on the upstream side and the downstream side in the paper traveling direction such that the pressing forces of the two pressed portions can be varied individually and independently of each other similarly as in the first embodiment. Consequently, a necessary pressure can be applied efficiently to paper in response to the density required for the paper. For example, not only to bulky paper but also to paper for which a comparatively high density is required such as coated base paper, a necessary pressure can be applied efficiently to consolidate the paper. Further, since this can be achieved solely by the shoe press apparatus, there is no necessity to provide a pair of rolls for pressing coated base paper as in the prior art shoe press apparatus described hereinabove, and also increase in scale of the apparatus can be prevented. Furthermore, the advantages described above can be implemented by such a simple construction that the pressed portion is divided into two pressed portions as in the present embodiment.

Further, the shoe 52 in the present embodiment does not involve such a gap 22 as in the first embodiment. Therefore, the present embodiment is advantageous also in that even a little increase in rewetting water amount does not occur, which is different from the first embodiment.

D. Fourth Embodiment

Figure 6:
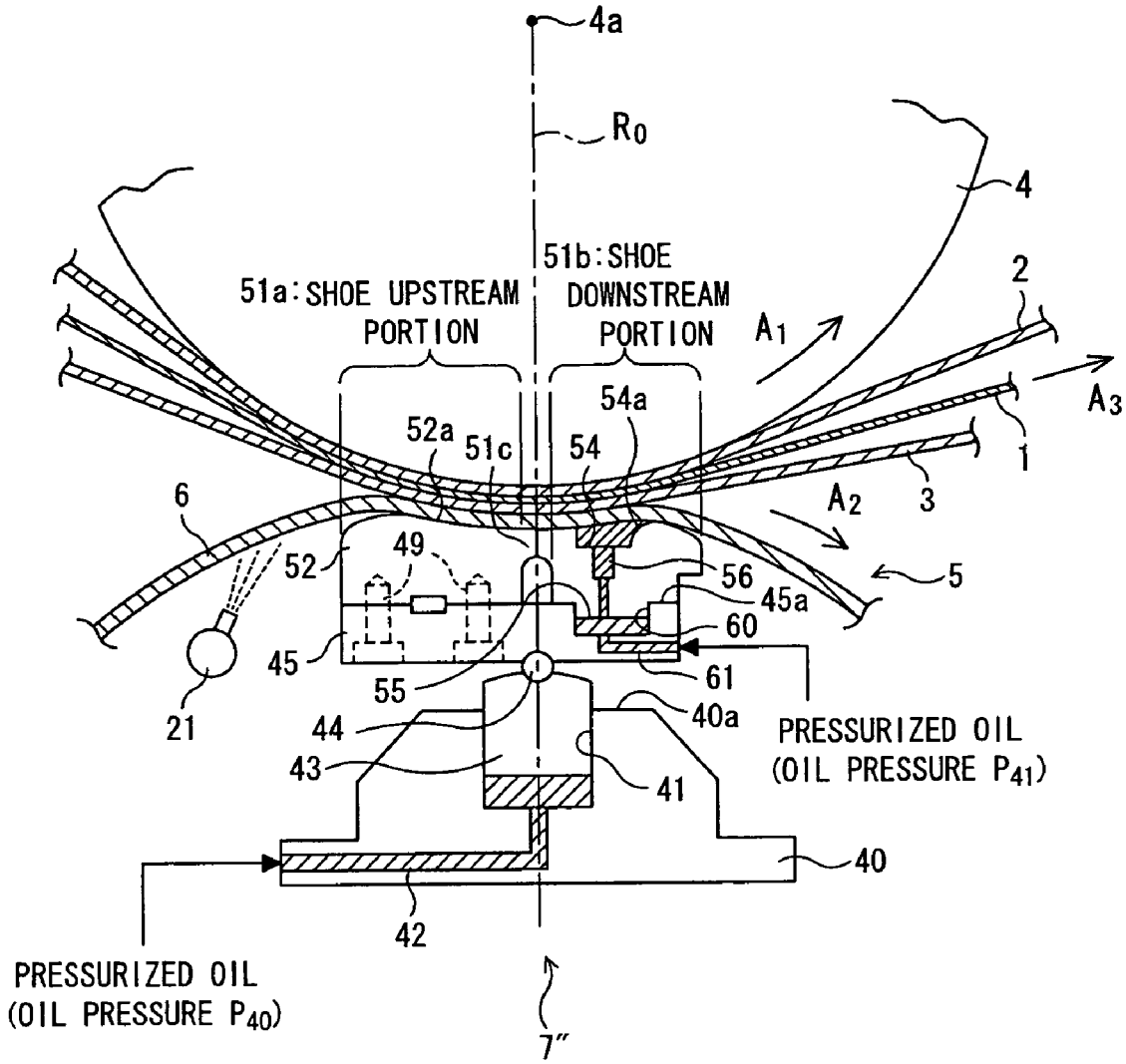
FIG. 6 shows a shoe press apparatus of a paper machine according to a fourth embodiment of the present invention and is a sectional view taken along a plane perpendicular to the width direction of the shoe press apparatus (direction perpendicular to the plane of the figure)
Figure 7:
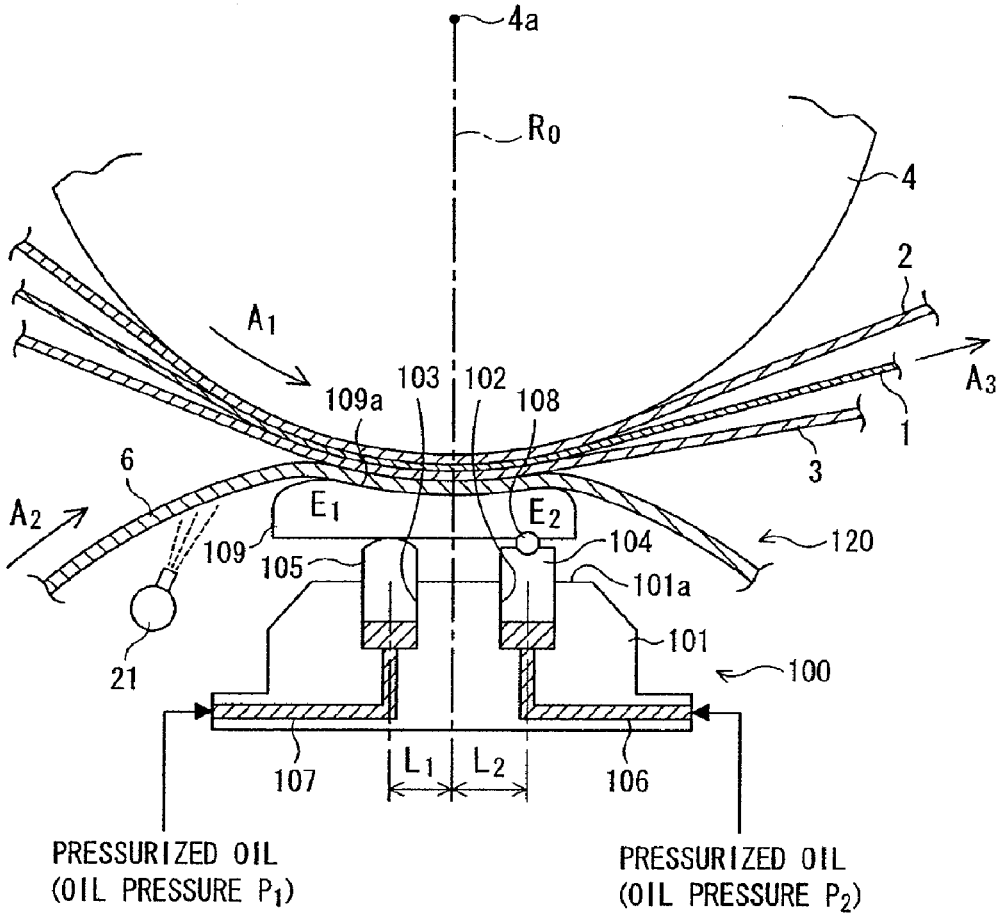
PRIOR ART FIG. 7
FIG. 7 shows a shoe press apparatus of a conventional paper machine and is a sectional view taken along a plane perpendicular to the width direction of the shoe press apparatus (direction perpendicular to the plane of the figure)
Figure 8A:
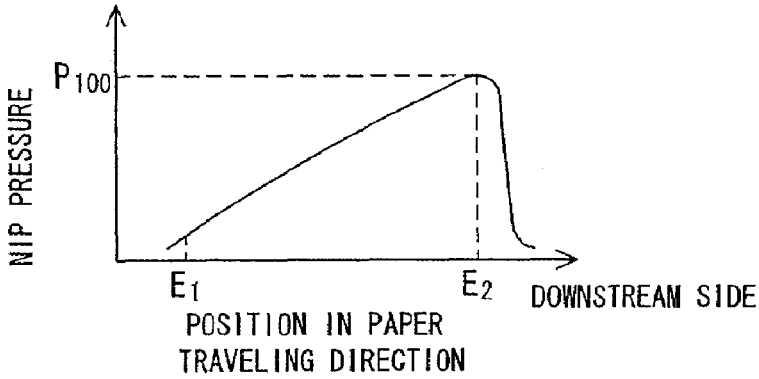
PRIOR ART FIG. 8(a)
FIGS. 8(*a*), 8(*b*) and 8(*c*) are diagrams illustrating pressure profiles of a shoe of the shoe press apparatus shown in FIG. 7 at a position in a paper traveling direction.
Figure 8B:
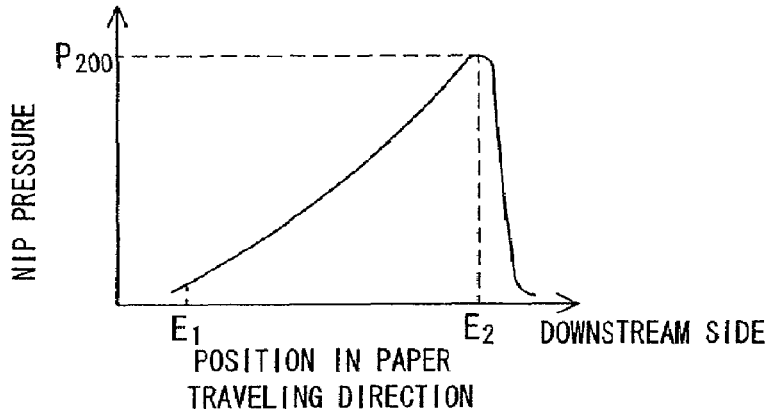
PRIOR ART FIG. 8(b)
Figure 8C:
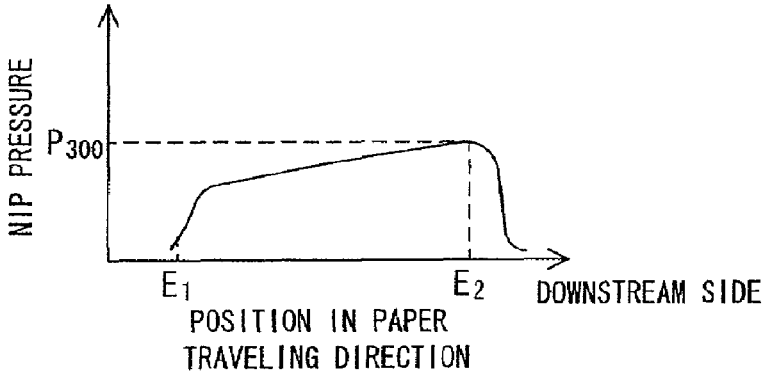
PRIOR ART FIG. 8(c)

FIG. 6 shows a shoe press apparatus of a paper machine according to a fourth embodiment of the present invention and particularly is a sectional view taken along a plane perpendicular to the width direction of the shoe press apparatus (direction perpendicular to the plane of the figure). It is to be noted that, in FIG. 6, like elements to those of the prior art apparatus and the first embodiment described hereinabove are denoted by like reference characters.

Referring to FIG. 6, the shoe press apparatus according to the present embodiment is different from that of the first embodiment in a press mechanism 7" of the shoe module 5. In the following, the press mechanism 7" is described while the configuration of the other part of the shoe press apparatus of the present embodiment is omitted herein because it is similar to that of the first embodiment.

The press mechanism 7" in the present embodiment includes a piston block 40 extending in the apparatus width direction. Here, the piston block 40 is disposed on a vertical line $R_0$ drawn in a vertically downward direction from the center 4*a* of rotation of the counter roll 4 (drawn in parallel to the direction of force by the piston 43). The piston block 40 has an upper face 40*a* formed horizontally (perpendicularly to the direction of force by the piston 43) in an opposing relationship to the center 4*a* of rotation of the counter roll 4. In other words, the center 4*a* of rotation of the counter roll 4 is positioned vertically upward of the upper face 40*a* of the piston block 40.

A grooved portion (recessed portion) 41 is provided on the upper face 40*a* of the piston block 40 such that it is formed in a belt-like shape fully along the apparatus width direction. The grooved portion 41 is formed perpendicularly to the upper face 40*a*. In other words, the grooved portion 41 is open toward the center 4*a* of rotation of the counter roll 4.

A piston 43 is fitted in the grooved portion 41, and a pressurized oil supply path 42 for supplying pressurized oil into a gap between a lower face of the piston 43 and a bottom portion of the grooved portion 41 is formed inside the piston block 40. As pressurized oil is supplied from the outside into the pressurized oil supply path 42, the piston 43 is moved in an upward direction, that is, in a direction toward the center 4*a* of rotation of the counter roll 4.

Further, a base member 45 is disposed on the piston 43 with a piston bar 44 interposed therebetween, and a shoe 52 is attached to an upper portion of the base member 45 by means of bolts 49. The upper face 52*a* of the shoe 52 contacts with the inner circumferential face of the blanket 6. The shoe 52 is formed as a plate extending in the apparatus width direction, and the upper face 52*a* of the shoe 52 is formed in an arcuate shape such that it extends along the outer circumferential face of the counter roll 4. Thus, if the piston 43 is moved in an upward direction, then the shoe 52 is pushed by the piston 43 through the piston bar 44 to press the blanket 6 toward its outer-surface, or more accurately toward the center 4*a* of rotation of the counter roll 4.

A portion (shoe upstream portion) 51*a* of the shoe 52 on the upstream side in the direction of rotation of the blanket 6 with respect to the vertical line $R_0$ is secured to an upper face of the base member 45 on the upstream side in the direction of rotation of the blanket 6 by means of the bolts 49 described above.

Meanwhile, a shoe grooved portion (recessed portion) 54 is formed on an upper face of another portion (shoe downstream portion) 51*b* of the shoe 52 on the downstream side in the direction of rotation of the blanket 6 with respect to the vertical line $R_0$. The shoe grooved portion 54 is formed in a belt-like shape fully along the apparatus width direction. Meanwhile, a projection 55 is formed on a lower face of the shoe downstream portion 51*b*. Furthermore, a portion of the shoe 52 between the shoe upstream portion 51*a* and the shoe downstream portion 51*b*, that is, a portion (connection portion) 51*c* of the shoe 52 at which the shoe 52 and the vertical line $R_0$ intersect with each other, is formed thinner than that of the shoe downstream portion 51*b* so that it can be deformed more readily than the shoe upstream portion 51*a* and the shoe downstream portion 51*b*.

A connection path 56 is formed inside the shoe downstream portion 51*b* such that it interconnects a bottom portion of the shoe grooved portion 54 and a lower face of the projection 55. Further, at a position of the upper face 45*a* of the base member 45 which corresponds to the shoe downstream portion 51*b*, that is, at a position of the upper face 45*a* of the base member 45 on the downstream side in the direction of rotation of the blanket 6, a shoe grooved portion (recessed portion) 60 is formed fully along the apparatus width direction. The projection 55 of the shoe downstream portion 51*b* is fitted in the shoe grooved portion 60. Further, a pressurized oil supply path 61 for supplying pressurized oil into a gap between a lower face of the projection 55 and a bottom portion of the shoe grooved portion 60 is formed inside the base member 45. As pressurized oil is supplied from the outside into the pressurized oil supply path 61, it is supplied into the gap between the lower face of the projection 55 of the shoe downstream portion 51*b* and the bottom portion of the shoe grooved portion 60 of the base member 45 through the pressurized oil supply path 61. Then, the pressurized oil is supplied into the shoe grooved portion 54 through the connection path 56 of the shoe downstream portion 51*b* to press the blanket 6 toward its outer-surface and supply the lubricating oil into the gap between the shoe 52 and the blanket 6.

The upper face 52*a* of the shoe 52 is formed in a rounded manner at end portions thereof on the upstream side and the downstream side in the direction of rotation of the blanket 6 so that damage to the blanket 6 may be prevented. Further, also a wall portion 54*a* of the shoe grooved portion 54 on the downstream side in the direction of rotation of the blanket 6 is formed in a rounded manner at an upper portion thereof so that damage to the blanket 6 may be prevented similarly.

Since the shoe press apparatus of a paper machine according to the fourth embodiment of the present invention is configured in such a manner as described above, the pressing force of the entire shoe 52 can be adjusted by adjusting the oil pressure $P_{40}$ of the pressurized oil to be supplied into the pressurized oil supply path 42. Further, the pressing force of the shoe downstream portion 51*b* can be adjusted by adjusting the oil pressure $P_{41}$ of the pressurized oil to be supplied into the pressurized oil supply path 61.

In this manner, also in the present embodiment, the pressed portion at the nip portion can be divided into two pressed portions (here, the shoe upstream portion 51*a* is a hydrodynamic pressure portion and the shoe downstream portion 51*b* is a static pressure portion) on the upstream side and the downstream side in the paper traveling direction such that the pressing forces of the two pressed portions can be varied individually and independently of each other similarly as in the first embodiment. Consequently, a necessary pressure can be applied efficiently to paper in response to the density required for the paper. For example, a necessary pressure can be applied efficiently to consolidate paper not only to bulky paper but also to paper for which a comparatively high density is required such as coated base paper. Further, since this can be achieved solely by the shoe press apparatus, there is no necessity to provide a pair of rolls for pressing coated base paper as in the prior art shoe press apparatus described hereinabove, and also increase in scale of the apparatus can be prevented. Furthermore, the advantages described above can be implemented by such a simple construction that the pressed portion is divided into two pressed portions as in the present embodiment.

Further, the shoe 52 in the present embodiment does not involve such a gap 22 as in the first embodiment. Therefore, the present embodiment is advantageous also in that even a little increase in rewetting water amount does not occur, which is different from the first embodiment.

E. Others

While embodiments of the present invention have been described, the present invention is not limited to the embodiments specifically described above, and variations and modifications can be made without departing from the scope of the present invention.

For example, while, in the embodiments described hereinabove, the shoe press apparatus is provided in a dewatering section of a paper machine, the shoe press apparatus may be provided not only in a dewatering section, but, for example, in a calender section which is provided on the downstream side with respect to the dewatering section and provides luster to the surface of the wet paper 1.

Further, while the pressure type of the two pressed portions is set, in the first embodiment, to the hydrodynamic pressure-hydrostatic pressure type, in the second embodiment, to the hydrodynamic pressure-hydrodynamic pressure type, in the third embodiment, to the hydrodynamic pressure-hydrodynamic pressure type and in the fourth embodiment, to the hydrodynamic pressure-hydrostatic pressure type, the combination of a hydrostatic pressure or pressures and a hydrodynamic pressure or pressures is not limited to those described above.

Further, while, in the embodiments described above, the pressed portion is divided into two pressed portions in the paper traveling direction at the nip portion, it may otherwise be divided into a greater number of pressed portions.

What is claimed is:

1. A shoe press apparatus of a paper machine for pressing wet paper through a nip, said shoe press apparatus comprising:

a counter roll; and a shoe module disposed adjacent to said counter roll so as to form a nip, and including a cylindrical blanket, and a press mechanism disposed inside said cylindrical blanket, said press mechanism extending in a width direction of said cylindrical blanket and individually pressing a plurality of pressed portions formed on said cylindrical blanket along a traveling direction of the wet paper, toward an outer-surface of said counter roll so that the wet paper is pressed in the nip between said cylindrical blanket and said counter roll, the pressed portions having an upstream side in the traveling direction of the wet paper and a downstream side in the traveling direction of the wet paper, said press mechanism being operable to apply a first oil film to said cylindrical blanket using hydrodynamic pressure at the upstream side of the pressed portions, and being operable to apply a second oil film to said cylindrical blanket using hydrostatic pressure at the downstream side of the pressed portions.

2. A shoe press apparatus of a paper machine as claimed in claim 1 disposed in a dewatering stage in the paper machine, further comprising:

a first felt web covering an over side of the wet paper and a second felt web covering an under side of the wet paper, said first and second webs traveling with the wet paper through the nip between said cylindrical blanket and said counter roll, said press mechanism pressing the wet paper between said first and second felt webs.

3. A shoe press apparatus of a paper machine as claimed in claim 2, wherein said press mechanism is one of a pair of press mechanisms, each press mechanism in said pair of press mechanisms being individually disposed along the traveling direction of the wet paper, and individually pressing said pressed portions, wherein the one of said pair of press mechanisms is disposed downstream of another of said pair of press mechanisms and applies the second oil film to said cylindrical blanket using hydrostatic pressure at the downstream side of the pressed portions, and the other of said pair of press mechanisms applies the first oil film to said cylindrical blanket using hydrodynamic pressure at the upstream side of the pressed portions.

4. A shoe press apparatus of a paper machine as claimed in claim 3, wherein a gap between said press mechanisms is set less than or equal to 50 mm.

5. A shoe press apparatus of a paper machine as claimed in claim 4, wherein each press mechanism in said pair of press mechanisms individually presses the wet paper through said cylindrical blanket toward a center of said counter roll.

6. A shoe press apparatus of a paper machine as claimed in claim 3, wherein each press mechanism in said pair of press mechanisms individually presses the wet paper through said cylindrical blanket toward a center of said counter roll.

7. A shoe press apparatus of a paper machine as claimed in claim 1, wherein said press mechanism is one of a pair of press mechanisms, each press mechanism in said pair of press mechanisms being individually disposed along the traveling direction of the wet paper, and individually pressing said pressed portions, wherein the one of said pair of press mechanisms is disposed downstream of another of said pair of press mechanisms and applies the second oil film to said cylindrical blanket using hydrostatic pressure at the downstream side of the pressed portions, and the other of the pair of said press mechanisms applies the first oil film to said cylindrical blanket using hydrodynamic pressure at the upstream side of the pressed portions.

8. A shoe press apparatus of a paper machine as claimed in claim 7, wherein a gap between said press mechanisms is set less than or equal to 50 mm.

9. A shoe press apparatus of a paper machine as claimed in claim 8, wherein each press mechanism in said pair of press mechanisms individually presses the wet paper through said cylindrical blanket toward a center of said counter roll.

10. A shoe press apparatus of a paper machine as claimed in claim 7, wherein each press mechanism in said pair of press mechanisms individually presses the wet paper through said cylindrical blanket toward a center of said counter roll.

11. A shoe press apparatus of a paper machine for pressing wet paper through a nip, said shoe press apparatus comprising:

a counter roll, a shoe module disposed adjacent to said counter roll so as to form a nip, and including a cylindrical blanket, and a press mechanism disposed inside said cylindrical blanket, said press mechanism extending in a width direction of said cylindrical blanket and individually pressing a plurality of pressed portions formed on said cylindrical blanket along a traveling direction of the wet paper, toward an outer-surface of said counter roll so that the wet paper is pressed in the nip between said cylindrical blanket and said counter roll, said pressed portions including an upstream pressed portion, and a downstream pressed portion disposed downstream of said upstream pressed portion in the traveling direction of the wet paper;

a first press mechanism operable to press said upstream pressed portion;

a second press mechanism operable to press said downstream press portion; and a connecting portion connecting said first and second press mechanisms and being thinner than said first and second press mechanisms.

* * * * *